US007973759B2

(12) United States Patent
Huang et al.

(10) Patent No.: US 7,973,759 B2
(45) Date of Patent: Jul. 5, 2011

(54) SYSTEM AND METHOD FOR DRIVING LIGHT EMITTERS OF BACKLIGHT MODULE USING CURRENT MIXING

(75) Inventors: Zhi-Xian Huang, Taichung County (TW); Hong-Xi Cao, Kaohsiung County (TW); Kun-Chieh Chang, Tainan (TW); Chun-Chieh Yang, Kaohsiung (TW); Fu-Shun He, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 1297 days.

(21) Appl. No.: 11/580,844

(22) Filed: Oct. 16, 2006

(65) Prior Publication Data

US 2008/0007510 A1 Jan. 10, 2008

Related U.S. Application Data

(60) Provisional application No. 60/818,521, filed on Jul. 6, 2006.

(51) Int. Cl.
*G09G 3/36* (2006.01)

(52) U.S. Cl. ..... 345/102; 345/76; 345/82; 345/83; 315/149; 315/291

(58) Field of Classification Search ..... 345/76–83, 345/102; 315/149, 291
See application file for complete search history.

(56) References Cited

U.S. PATENT DOCUMENTS

| | | | | |
|---|---|---|---|---|
| 6,127,783 | A | 10/2000 | Pashley et al. | |
| 6,396,466 | B1 * | 5/2002 | Pross et al. | 345/82 |
| 6,441,558 | B1 * | 8/2002 | Muthu et al. | 315/149 |
| 6,445,139 | B1 | 9/2002 | Marshall et al. | |
| 6,495,964 | B1 | 12/2002 | Muthu et al. | |
| 6,630,801 | B2 | 10/2003 | Schuurmans | |
| 6,841,947 | B2 | 1/2005 | Berg-johansen | |
| 6,894,442 | B1 | 5/2005 | Lim et al. | |
| 6,897,622 | B2 | 5/2005 | Lister | |
| 6,963,175 | B2 | 11/2005 | Archenhold et al. | |
| 2003/0218585 | A1 * | 11/2003 | Hoshi et al. | 345/82 |
| 2005/0231459 | A1 * | 10/2005 | Furukawa | 345/102 |
| 2006/0245174 | A1 * | 11/2006 | Ashdown et al. | 362/85 |
| 2007/0120542 | A1 * | 5/2007 | LeMay | 323/229 |

* cited by examiner

*Primary Examiner* — Richard Hjerpe
*Assistant Examiner* — Saifeldin Elnafia
(74) *Attorney, Agent, or Firm* — Finnegan, Henderson, Farabow, Garrett & Dunner, LLP

(57) ABSTRACT

A system and a method for driving light emitters of a liquid crystal display (LCD) backlight module is disclosed. The system drives the light emitters by supplying a constant current and a pulse width modulated current to an individual light emitter, the pulse width modulated current being determined in accordance with an optical output of the light emitter. Accordingly, the system can provide a desired amount of current to the light emitters, and individually control the optical output of the light emitters.

29 Claims, 10 Drawing Sheets

SYSTEM AND METHOD FOR DRIVING LIGHT EMITTERS OF BACKLIGHT MODULE USING CURRENT MIXING

RELATED APPLICATIONS

This application claims the benefit of priority from U.S. Provisional Application No. 60/818,521, filed Jul. 6, 2006, the entirety of which is expressly incorporated herein by reference in its entirety.

FIELD OF THE INVENTION

The present invention relates generally to a system and a method for actuating a backlight module of a flat panel display. More particularly, the present invention relates to a system and a method for driving a backlight module using current mixing.

BACKGROUND OF THE INVENTION

Liquid crystal displays (LCD) typically include a liquid crystal panel which is backlit with a white light source. White light generated by the source passes through individual pixels of the liquid crystal panel and is color filtered. A user viewing the LCD sees such color-filtered light as the image generated by the LCD.

Known white light sources include cold cathode fluorescent lamps (CCFLs). Other white light sources include colored light emitting diodes (LEDs). Typically, such LED-based white light sources include clusters of three LEDs, one emitting blue light, and the other two emitting green and red light, respectively. In each cluster, the LEDs are positioned close to one another so that the light from each is mixed with the other LEDs of the cluster. The combined output of the red, blue, and green light output from each cluster thus appears white. Many such LED clusters are often provided to illuminate the entire liquid crystal panel.

LED-based white light sources are advantageous in that they output light over a broader range of colors and have better color saturation than many CCFLs.

In order for white light to be emitted from the LED clusters, the light intensity associated with each LED is typically maintained at a particular value. Over time, however, each LED tends to emit less light, and the rate of such decaying light intensity varies for each LED. As a result, the white light source may appear to have a colored hue, either over the entire display or in localized portions, instead of being white. Changes in temperature can also create such a colored hue by affecting the intensity of light output by the LEDs.

In order to maintain the desired light intensity output from each LED, i.e., maintain a desired "color balance," a feedback system may be provided to compensate for the above-noted color variations. Namely, detectors may be provided adjacent the white light source in order to detect the overall intensity of red, blue, and green light emitted by the source. If an excess amount of blue light is detected, for example, a control circuit may adjust the current supplied to the red, blue, and green LEDs of the LCD so that the overall intensity of red, blue, and green light output from the source is at a desired level.

Since the feedback circuit monitors the light intensity of the white light source as a whole, it cannot ensure that white light is generated by individual clusters of LEDs. As a result, portions of the white light source may still not have a desired color balance, even when the above-noted feedback circuit is employed.

In addition, the current-voltage (I-V) curve associated with each LED is non-linear, such that small changes in voltage result in disproportionate changes in current. Accordingly, the current flowing through each LED (and thus the brightness or intensity associated with each LED) is typically not controlled by adjusting the voltage across the LED. Rather, current pulses are applied to each LED instead, whereby the width of each pulse is either widened or shortened in order to increase or decrease the total amount of current supplied to each LED. Such pulse width modulated (PWM) current, however, often does not supply a sufficient amount of current for the LEDs to generate a maximum light intensity. The maximum light intensity can be achieved, however, with known current driving integrated circuits (ICs), but such ICs typically supply the desired amount of current to a limited number of LEDs. Accordingly, often many such current driving ICs are necessary in order to provide the desired amount of current to each LED, thereby increasing the cost of LCDs including LED-based white light sources.

SUMMARY OF THE INVENTION

In light of the above, the present invention is to provide a system and a method for individually driving light emitters of a backlight module using current mixing, such that a high current is supplied to light emitters, and a color balance in the entire region of light source is ensured.

In one aspect, there is provided a circuit for driving a light emitter. The circuit includes a bias circuit, a driving circuit, and a control circuit. The bias circuit is coupled to a first portion of a current path. The driving circuit is coupled to a second portion of the current path. The light emitter is coupled to a third portion of the current path between the first and second portions of the current path. The control circuit is coupled to a fourth portion of the current path between the first and second portions. The light emitter receives a current flowing along the current path. The control circuit is configured to regulate the current flowing along the current path in response to an optical output of the light emitter, thereby driving the light emitter with the regulated current.

In another aspect, there is provided an illuminating system. The illumination includes a plurality of light emitters, each of which being coupled to a corresponding one of a plurality of current paths, a bias circuit coupled to the plurality of current paths and being configured to supply a constant current to each of the plurality of current paths, and a control circuit coupled to the plurality of current paths and being configured to generate a plurality of modulation currents, each of the plurality of modulation currents varying based on an optical output of a respective one of the light emitters. Each of the plurality of light emitters receives a corresponding one of a plurality of driving currents from a respective one of the plurality of current paths, each of the plurality of driving currents being based on a corresponding one of the plurality of modulation currents and the constant current.

In yet another aspect, there is provided a method for driving a light emitter. The method includes the steps of generating a first current, generating a second current based on an optical output of the light emitter, and supplying a third current to the light emitter, the third current being based on the first current and the second current.

It is to be understood that both the foregoing general description and the following detailed description are exemplary and explanatory only, and are not restrictive of the invention, as claimed.

DESCRIPTION OF THE EMBODIMENTS

Reference will now be made in detail to embodiments consistent with the invention, examples of which are illustrated in the accompanying drawings. Wherever possible, the same reference numbers will be used throughout the drawings to refer to the same or like parts.

Figure 1:
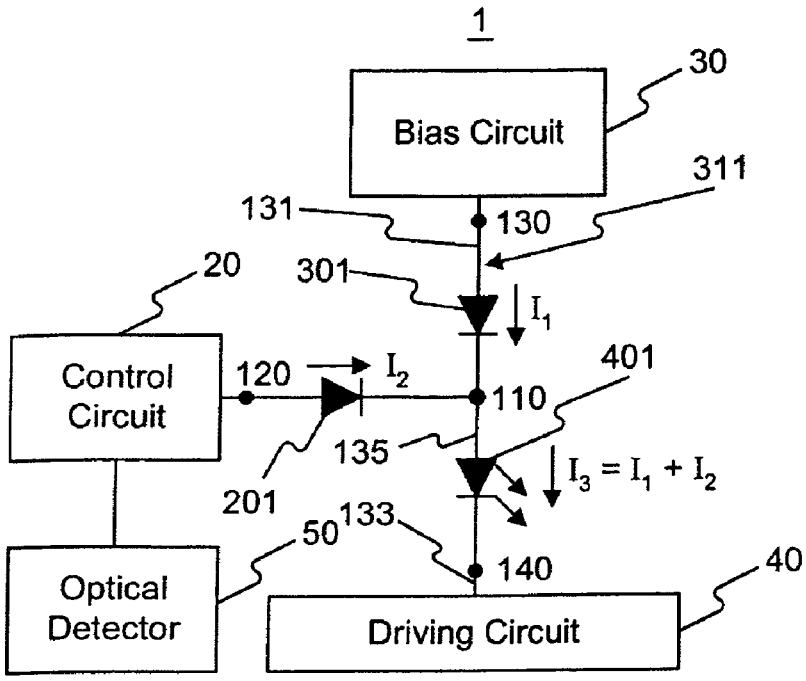
FIG. 1 illustrates a circuit for driving an LED, in accordance with one embodiment consistent with the present invention.

FIG. 1 shows a circuit 1 for driving a light emitter 401, in accordance with one embodiment consistent with the invention. Circuit 1 includes a control circuit 20, a bias circuit 30, and a driving circuit 40.

Bias circuit 30 is coupled to a first portion 131 (e.g., point 130 to point 110) of a current path 311, which includes an optional diode 301. In this embodiment, bias circuit 30 supplies a constant current $I_1$ to current path 311. Diode 301 is optionally provided to direct the constant current $I_1$ to flow only from bias circuit 30 to point 110. Diode 301 may be absent from the first portion 131 of current path 311, if no harmful reverse current flows back toward bias circuit 30.

Driving circuit 40 is coupled to a second portion 133 (e.g. from driving circuit 40 to point 140) of current path 311, and light emitter 401 is coupled to a third portion 135 (e.g., point 110 to point 140) of current path 311. In one embodiment, light emitter 401 includes a LED. Third portion 135 of current path 311 is coupled between the first (131) and second (133) portions of current path 311. Light emitter 401 receives a current $I_3$ flowing along current path 311 between bias circuit 30 and driving circuit 40.

As further shown in FIG. 1, an optical detector 50, such as a photodiode, may be provided to sense light output from light emitter 401. In response to such sensed light, optical detector 50 outputs an electrical signal, which is supplied to control circuit 20. Control circuit 20, in turn, generates a PWM current $I_2$ to point 110. Current $I_2$ has a duty cycle based on the received electrical signal. Accordingly, changes in light output from light emitter 401 result in changes in the electrical signal output from optical detector 50 and corresponding changes in the duty cycle of current $I_2$. Thus, the duty cycle of current $I_2$ can be adjusted in response to variations in light output from light emitter 401.

It is noted that diode 201 is optional and is provided to block damaging reverse current from flowing to control circuit 20. In the absence of such spurious currents, diode 201 may be omitted.

Driving circuit 40 allows a driving current $I_3$ to flow through light emitter 401, thereby driving light emitter 401. The driving current $I_3$ is formed by combining constant current $I_1$ and PWM current $I_2$. In this embodiment, driving current $I_3$ is a sum of constant current $I_1$ and PWM current $I_2$, i.e., $I_3=I_1+I_2$.

Figure 2:
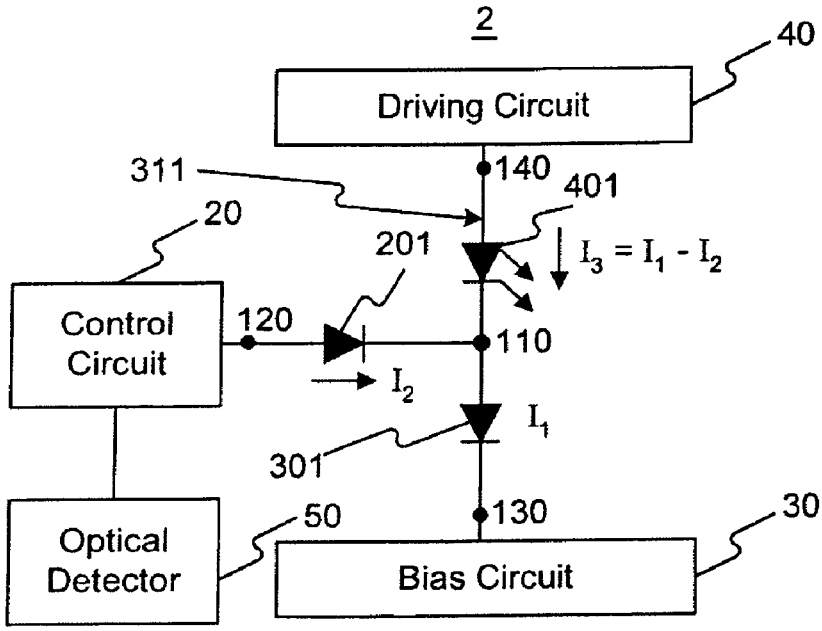
FIG. 2 illustrates a circuit for driving an LED, in accordance with another embodiment consistent with the present invention.

FIG. 2 illustrates circuit 2 consistent with another embodiment of the present invention. Circuit 2 is similar to circuit 1, but the locations of light emitter 401 and diode 301 are reversed. In addition, the connections of driving circuit 40 and bias circuit 30 are reversed. Accordingly, driving circuit 40 outputs current $I_3$, instead of receiving current $I_3$, as in FIG. 1. In addition, bias circuit 30 receives current $I_1$, which is typically constant.

In the example shown in FIG. 2, current $I_2$ is generated in a manner similar to that discussed above in regard to FIG. 1 and is fed to point 110 along current path 311. Currents $I_1$ and $I_2$ are thus combined in circuit 2 to yield driving current $I_3$. As a result, driving current $I_3$ flowing through light emitter 401 is equal to a difference between bias $I_1$ and $I_2$, i.e., $I_3=I_1-I_2$.

Figure 3:
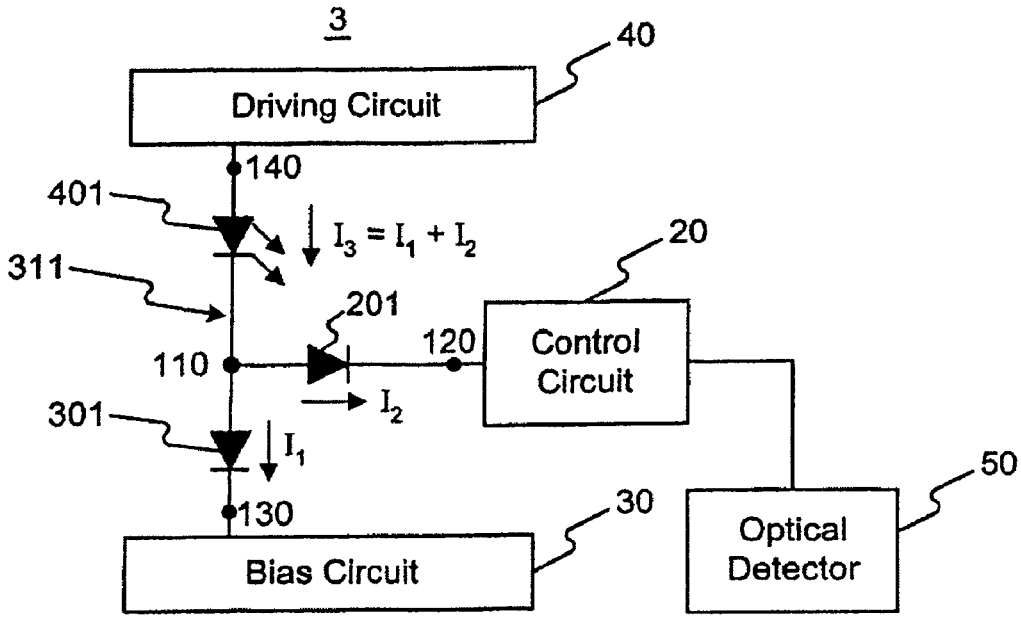
FIG. 3 illustrates a circuit for driving an LED, in accordance with one embodiment consistent with the present invention.
Figure 4:
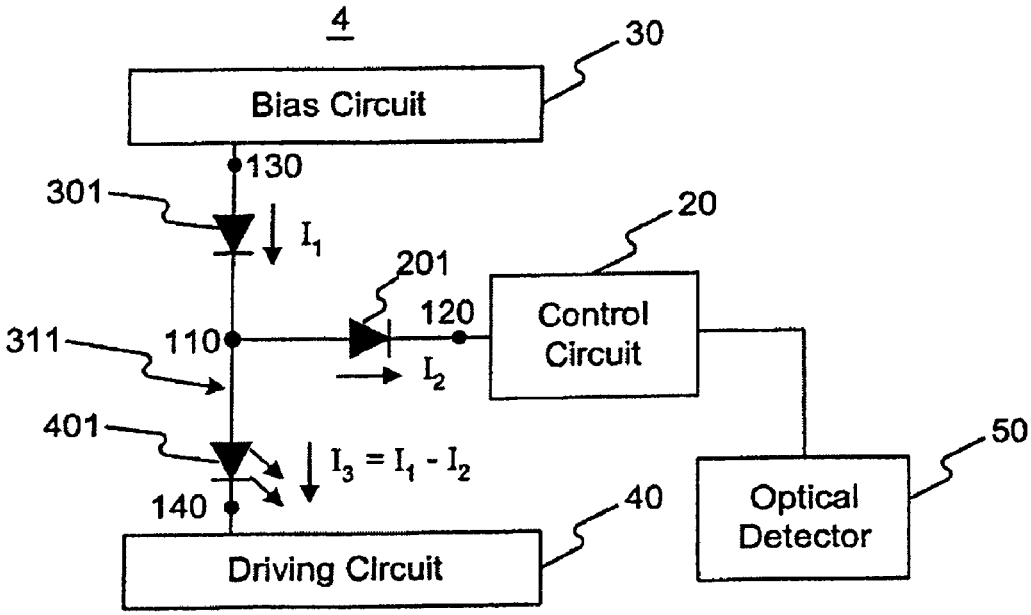
FIG. 4 illustrates a circuit for driving an LED, in accordance with another embodiment consistent with the present invention.

FIGS. 3 and 4 illustrate circuits 3 and 4, respectively, which are consistent with further embodiments of the present invention. Circuit 3 is similar to circuit 2 discussed above, but diode 201 is reversed to permit current $I_2$ to flow toward control circuit 20 instead of away from it. That is, control circuit 20 generates a negative current instead of a positive current as in FIG. 2. Otherwise, current $I_2$ is generated in a similar fashion as that discussed above in regard to FIGS. 1 and 2, i.e., the duty cycle of $I_2$ is in response to light output from LED 401. In FIG. 3, current $I_3$ satisfies: $I_3=I_1-(-I_2)$. Put another way, $I_3=I_1+I_2$.

Turning to FIG. 4, circuit 4 is similar to circuit 1 shown in FIG. 1, but diode 201 is reversed in this example as well. Here also, control circuit 20 generates a negative PWM current, having a duty cycle which varies in accordance with the light output from light emitter 401. In FIG. 4, current $I_3$ satisfies: $I_3=I_1-I_2$.

Figure 5:
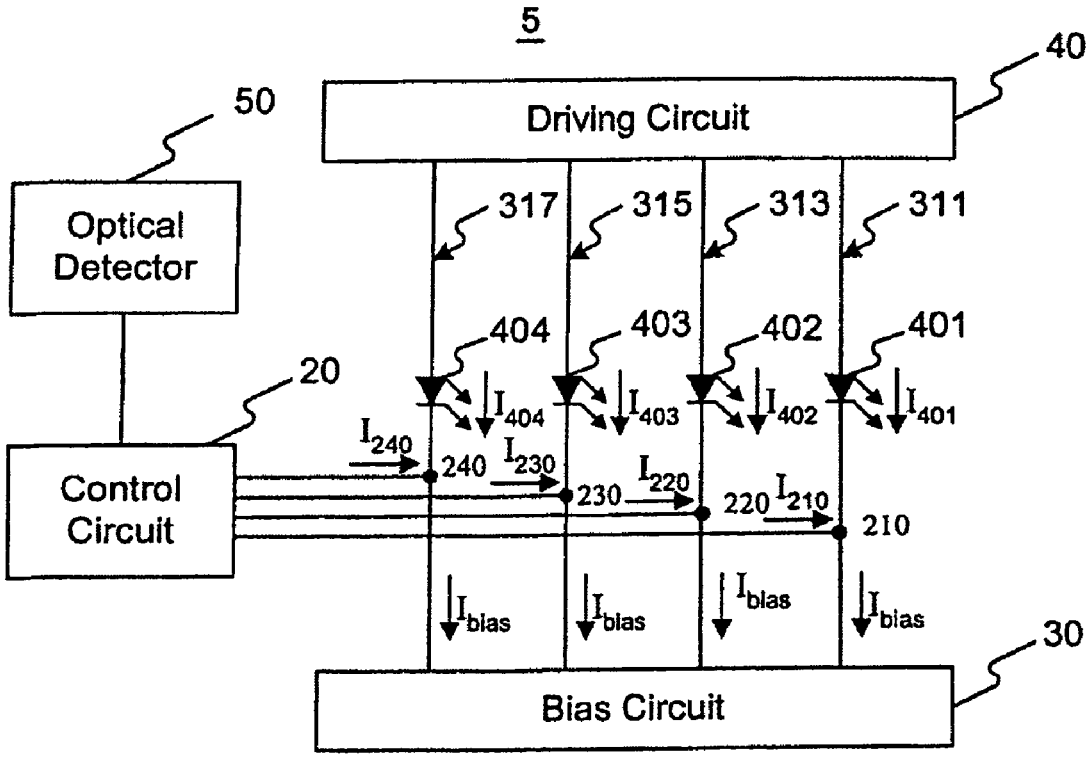
FIG. 5 illustrates a circuit for driving a plurality of LEDs, in accordance with one embodiment consistent with the present invention.

Referring now to FIG. 5, a circuit 5 is illustrated for driving a plurality of light emitters 401, 402, 403, and 404. Circuit 5 includes a driving circuit 40, a control circuit 20, and a bias circuit 30. In this example, light emitters 401, 402, 403, and 404 include LEDs. Each of light emitters 401, 402, 403, and 404 is coupled to one of corresponding current paths 311, 313, 315, and 317. Light emitters 401, 402, 403, and 404 are arranged in parallel. Bias circuit 30 supplies a constant current $I_{bias}$ to each of light emitters 401, 402, 403, and 404 through each of corresponding current paths 311, 313, 315, and 317. Control circuit 20 supplies correspondingly PWM currents $I_{210}$, $I_{220}$, $I_{230}$, and $I_{240}$, to individual light emitters 401, 402, 403, and 404 through points 210, 220, 230, and 240, respectively, in response to an optical output of individual light emitters 401, 402, 403, and 404 detected by an optional optical detector 50, which is coupled to control circuit 20, as described above. Driving circuit 40 provides driving currents $I_{401}$, $I_{402}$, $I_{403}$, and $I_{404}$, to flow respectively through each of corresponding light emitters 401, 402, 403, and 404. The light emitters 401, 402, 403, and 404 are thus driven by the driving currents $I_{401}$, $I_{402}$, $I_{403}$, and $I_{404}$. In one embodiment, the driving currents $I_{401}$, $I_{402}$, $I_{403}$, and $I_{404}$ are sums of constant current $I_{bias}$ and PWM currents $I_{210}$, $I_{220}$, $I_{230}$, and $I_{240}$. In another embodiment, the driving currents $I_{401}$, $I_{402}$, $I_{403}$, and $I_{404}$ are differences of constant current $I_{bias}$ and PWM currents $I_{210}$, $I_{220}$, $I_{230}$, and $I_{240}$, if bias circuit 30 receives constant current $I_{bias}$.

Figure 6:
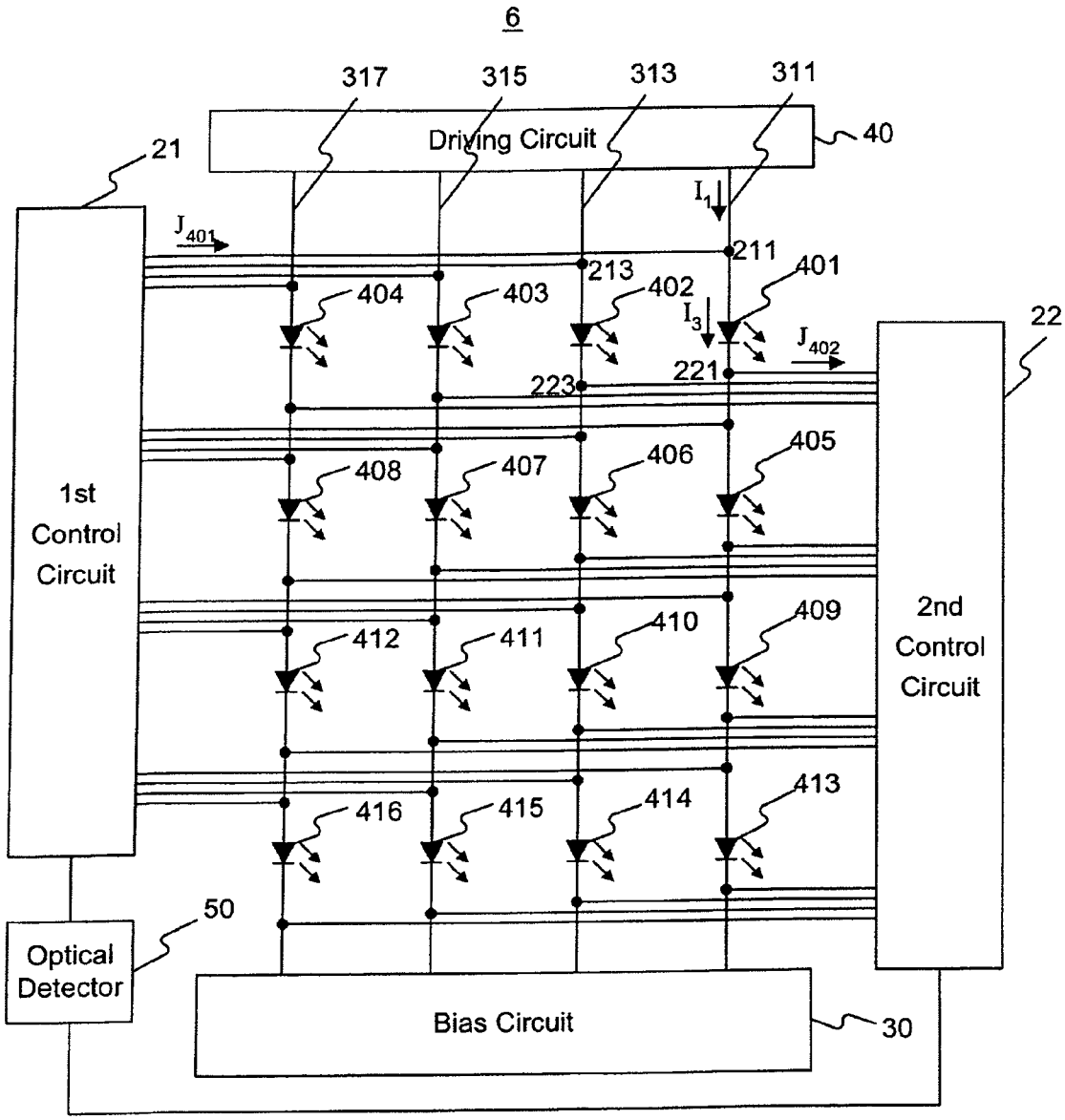
FIG. 6 illustrates a circuit for driving an LED array, in accordance with one embodiment consistent with the present invention.

FIG. 6 illustrates an illuminating system 6 in accordance with another embodiment consistent with the present invention. Illuminating system 6 includes a plurality of light emitters 401-416, a bias circuit 30, a driving circuit 40, a first control circuit 21, and a second control circuit 22.

As shown in FIG. 6, each of light emitters 401-416 is coupled to one of a plurality of current paths 311, 313, 315, and 317, which are typically arranged in parallel. Each of light emitters 401-416 typically includes an LED. In this example, light emitters 401, 405, 409, and 413 are coupled in series to current path 311; light emitters 402, 406, 410, and 414 are coupled in series to current path 313; light emitters 403, 407, 411, and 415 are coupled in series to current path 315; and light emitters 404, 408, 412, and 416 are coupled in series to current path 317. Bias circuit 30 is coupled to current paths 311, 313, 315, and 317 and is configured to supply a constant current $I_1$ to flow through each of the current paths.

The first control circuit 21 is coupled to the plurality of current paths 311, 313, 315, and 317, and is configured to generate a plurality of modulation currents $J_n$, where "n" identifies the light emitter which the modulation current is supplied to. For example, the first control circuit 21 generates modulation current $J_{401}$, and supplies modulation current $J_{401}$ to light emitter 401 via current path 311. Similarly, the first control circuit 21 generates modulation current $J_{402}$, and supplies modulation current $J_{402}$ to light emitter 402 via current path 313, and so on. In one embodiment, modulation currents $J_n$ are PWM currents. In the example shown in FIG. 6, the first control circuit 21 is a current source, but may alternatively be a current sink.

The second control circuit 22 is coupled to the plurality of current paths 311, 313, 315, and 317, and is configured to direct modulation currents $J_n$ flowing away from light emitters 401-416 via the current paths 311, 313, 315, and 317. As described above, each of modulation currents $J_n$ varies based on an optical output of a respective one of the light emitters 401-416. In this example, the second control circuit 22 is a current sink, but may alternatively be a current source.

Driving circuit 40 provides a driving current $I_3$ to flow through each of light emitters 401-416, thereby driving each of light emitters 401-416 separately. The driving current $I_3$ is based on constant current $I_1$ and modulation currents $J_n$, as described above. Since each modulation current $J_n$ supplied to one of light emitters 401-416 from the first control circuit 21 is directed to flow away from the respective one of light emitters 401-416 to the second control circuit 22, each modulation current $J_n$ only regulates driving current $I_3$ flowing through each individual light emitter. In one embodiment, driving circuit $I_3$ is substantially equal to the sum of constant current $I_1$ and modulation current $J_n$, i.e., $I_3=I_1+J_n$. In another embodiment, driving circuit $I_3$ is substantially equal to the difference of constant current $I_1$ and modulation current $J_n$, i.e., $I_3=I_1-J_n$.

In one example, if light emitter 401 requires driving current $I_3$ to be greater than constant current $I_1$ a modulation current $J_{401}$ is supplied from the first control circuit 21 to light emitter 401 via point 211 of current path 311, and flows through light emitter 401 to the second control circuit 22 via point 221 of current path 311. In this example, the first control circuit 21 is a current source, and the second control circuit 22 is a current sink.

In another example, if light emitter 402 requires driving current $I_3$ to be less than constant current $I_1$ a modulation current $J_{401}$ is directed to flow from current path 313 to first control circuit 21 via point 213, thus reducing the resultant driving current $I_3$ flowing through light emitter 402. The second control circuit 22 then supplies modulation current $J_{402}$ to current path 313 via point 223. Modulation current $J_{402}$ compensates modulation current $J_{401}$ flowing away from current path 313, thereby maintaining constant current $I_1$ flowing through current path 313. In this example, the first control circuit 21 is a current sink, and the second control circuit 22 is a current source.

Figure 7A:
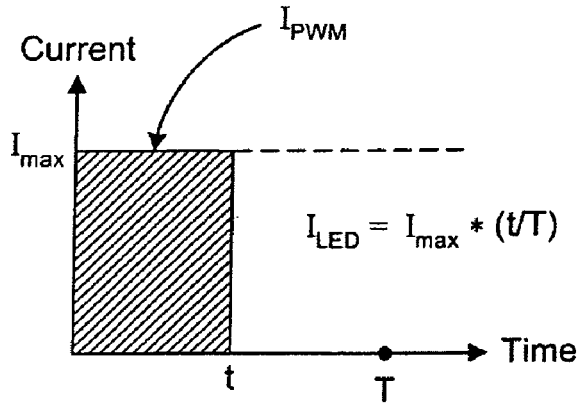
FIG. 7A is a time sequence diagram illustrating a PWM current having a duty cycle.
Figure 7B:
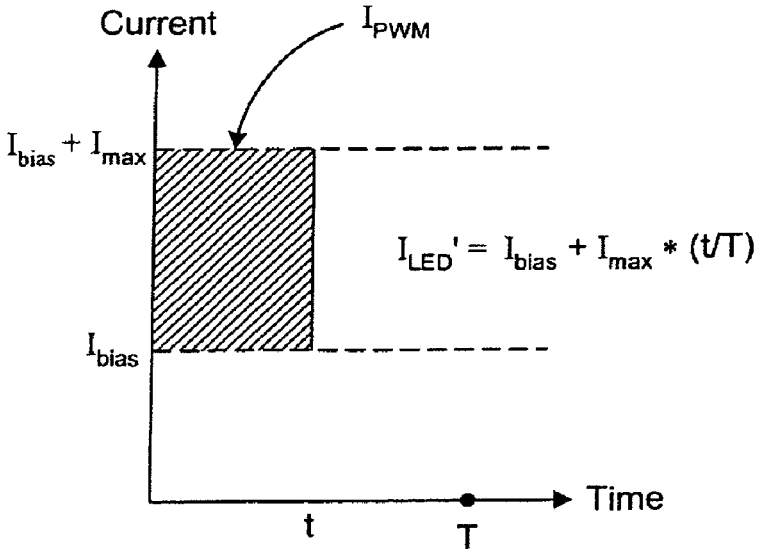
FIG. 7B is a time sequence diagram illustrating a PWM current modified by a constant current.

FIGS. 7A and 7B illustrate time sequence diagrams of a single pulse of a PWM current $I_{PWM}$ before and after a constant current is added. PWM current $I_{PWM}$ shown in FIG. 7A and FIG. 7B is characterized by a current amplitude $I_{max}$, a period T, and a pulse width t. The duty cycle of PWM current $I_{PWM}$ is a ratio of pulse width t to period T, i.e. t/T. Accordingly, by supplying PWM current $I_{PWM}$ to a light emitter, the light emitter is effectively driven by a driving current having an amplitude of $I_{LED}$, which is substantially equal to the current amplitude $I_{max}$ multiplied by the duty cycle, i.e., $I_{LED}=I_{max}*(t/T)$. In FIG. 7B, a constant current $I_{bias}$ can be added to PWM current $I_{PWM}$. By supplying to a light emitter PWM current $I_{PWM}$ with the added constant current $I_{bias}$, the light emitter is effectively driven by a driving current of amplitude $I_{LED'}$. Amplitude $I_{LED'}$ of the driving current is substantially equal to the constant current $I_{bias}$ plus the current amplitude $I_{max}$ multiplied by the duty cycle, i.e., $I_{LED}'=I_{bias}+I_{max}*(t/T)$.

Figure 8:
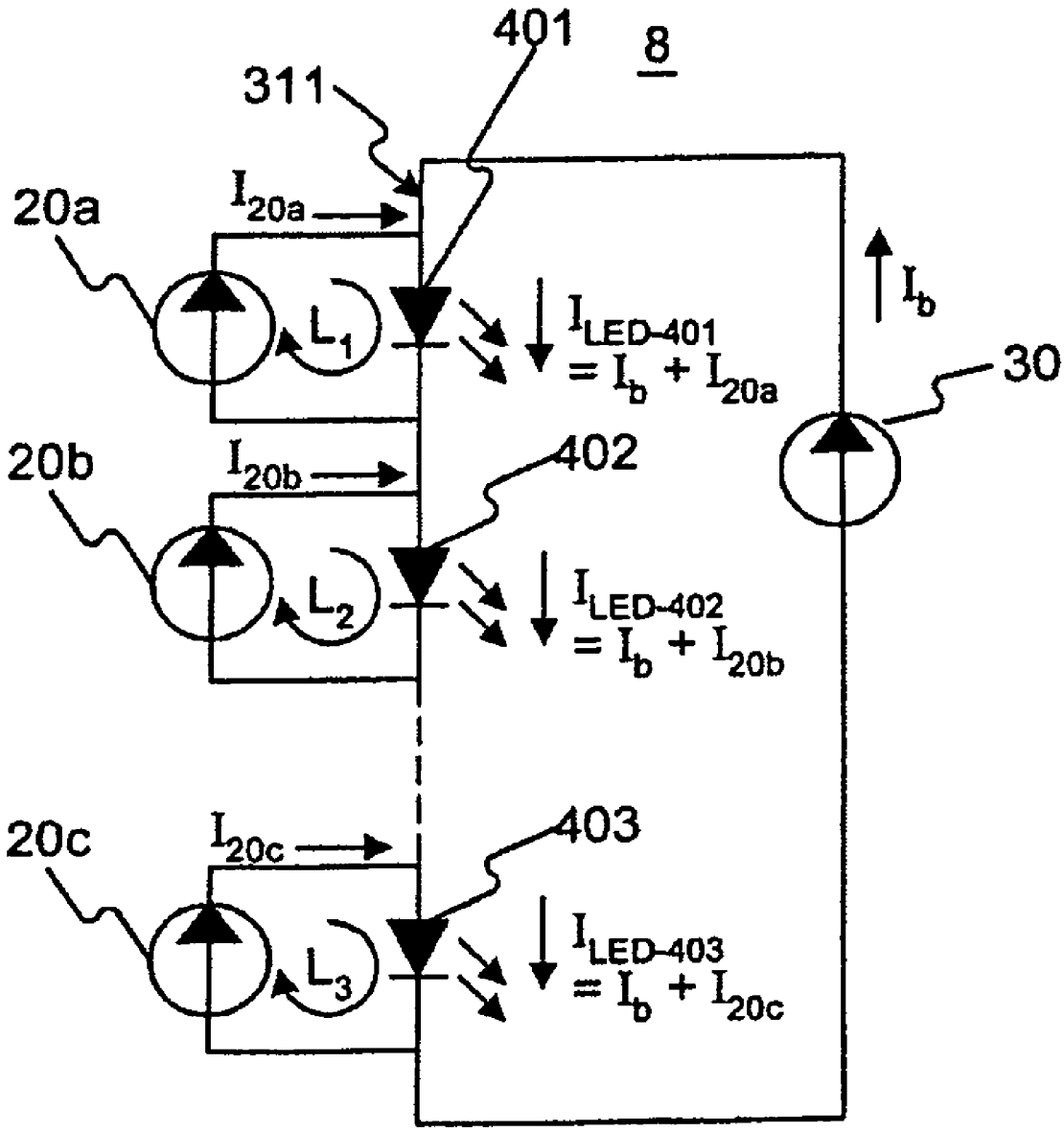
FIG. 8 schematically illustrates a circuit for individually driving a series of LEDs, in accordance with one embodiment consistent with the present invention.

Referring to FIG. 8, there is shown a schematic diagram of a circuit 8 for individually driving a series of light emitters 401, 402, and 403, in accordance with one embodiment consistent with the present invention. In this example, three light emitters 401, 402, and 403 are illustrated. In one embodiment, light emitters 401, 402, and 403 include LEDs. As shown, light emitters 401, 402, and 403 are electrically connected in series in a current path 311. It is understood that circuit 8 may drive any arbitrary number of light emitters. Circuit 8 includes a constant current source 30, and a plurality of modulation current sources 20*a*, 20*b*, and 20*c*. Constant current source 30 is coupled to current path 311 for supplying light emitters 401, 402, and 403 a constant current $I_b$. Each of modulation current sources 20*a*, 20*b*, and 20*c* is electrically connected across a respective one of light emitters 401, 402, and 403, thereby forming corresponding circuit loops $L_1$, $L_2$, and $L_3$. For example, modulation current source 20*a* and light emitter 401 form a circuit loop $L_1$ for supplying a modulation current $I_{20a}$ to light emitter 401 in addition to the constant current $I_b$. As a result, light emitter 401 is driven by a driving current $I_{LED\text{-}401}$, which is substantially equal to the sum of constant current $I_b$ and modulation current $I_{20a}$, i.e., $I_{LED\text{-}401}=I_b+I_{20a}$. Similarly, light emitters 402 and 403, and modulation current sources 20*b* and 20*c* form circuit loops $L_2$ and $L_3$, respectively. Light emitters 402 and 403 are thus driven by driving currents $I_{LED\text{-}402}$, and $I_{LED\text{-}403}$, which respectively equal the sum of constant current $I_b$ and modulation currents $I_{20b}$ and $I_{20c}$ supplied by modulation current sources 20*b* and 20*c*.

Figure 9A:
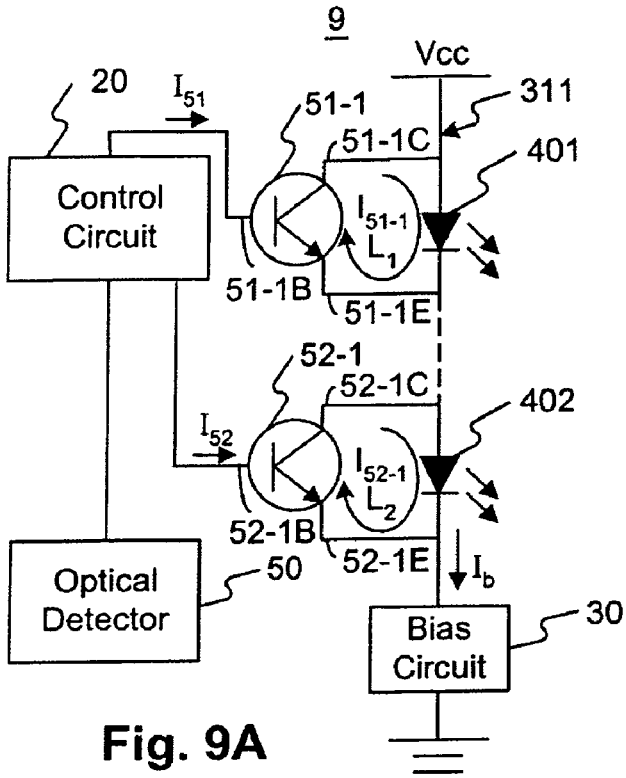
FIG. 9A illustrates a circuit for individually driving a series of LEDs, in accordance with one embodiment consistent with the present invention.
Figure 9B:
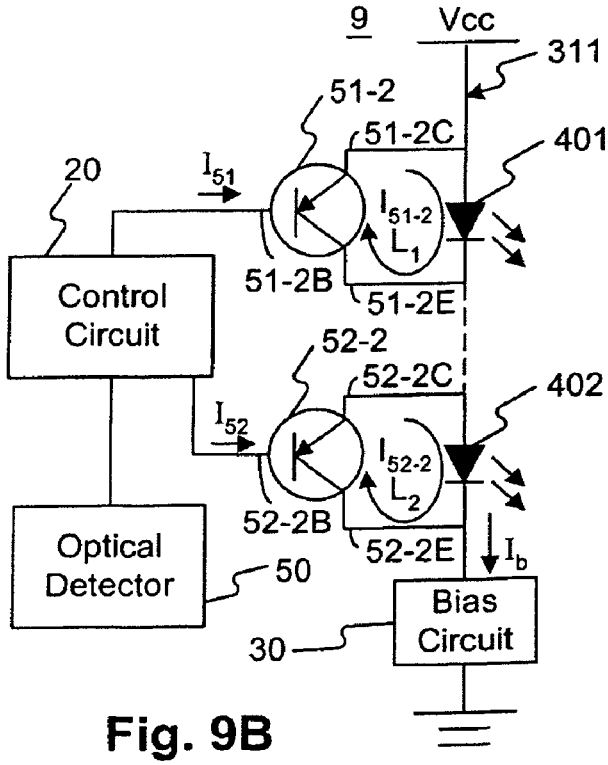
FIG. 9B illustrates a circuit for individually driving a series of LEDs, in accordance with one embodiment consistent with the present invention.

FIGS. 9A and 9B illustrate a circuit 9 for individually driving light emitters 401 and 402, in accordance with one embodiment consistent with the present invention. Circuit 9 includes a bias circuit 30 and a control circuit 20. Control circuit 20 further includes a plurality of amplifiers 51 and 52. Bias circuit 30 supplies a constant current to light emitters 401, 402, which are coupled in series along a current path 311. A constant voltage source $V_{cc}$ is also connected to current path 311. Each of amplifiers 51 and 52 is electrically connected across each of respective light emitters 401 and 402, thereby forming circuit loops $L_1$ and $L_2$. In one embodiment, as shown in FIG. 9A, amplifiers 51 and 52 include NPN transistors. In another embodiment, as shown in FIG. 9B, amplifiers 51 and 52 include PNP transistors.

Circuit 9 further includes an optional optical detector 50 coupled to control circuit 20. Optical detector 50 senses light output from light emitters 401 and 402 by sequentially turning on one of light emitters 401 and 402, while maintaining the other light emitters off. Optical detector 50 then supplies an electrical signal corresponding to one of light emitters 401 and 402 to control circuit 20 at any given time in a manner as described above. Accordingly, one optical detector 50 is sufficient to detect optical outputs of a plurality of light emitters 401 and 402, although a plurality of optical detectors may be used.

As shown in FIG. 9A, control circuit 20 supplies modulation currents $I_{51}$ and $I_{52}$ to bases 51-1B and 52-1B of NPN transistors 51-1 and 52-1. NPN transistors 51-1 and 52-1, in turn, amplify the modulation currents $I_{51}$ and $I_{52}$, and generate amplified modulation currents $I_{51-1}$ and $I_{52-1}$ between emitters 51-1E and 52-1E, and collectors 51-1C and 52-1C. As shown, emitters 51E and 52E, and collectors 51C and 52C are electrically connected across light emitters 401 and 402, respectively. Accordingly, amplified modulation currents $I_{51-1}$ and $I_{52-1}$, which flow in circuit loops $L_1$ and $L_2$, are supplied respectively to light emitters 401 and 402. Light emitters 401 and 402 are thus driven respectively by driving currents $I_{401}$ and $I_{402}$ which are substantially equal to a constant bias current $I_b$ plus the respective amplified modulation current $I_{51-1}$ and $I_{52-1}$.

As shown in FIG. 9B, control circuit 20 supplies modulation currents $I_{51}$ and $I_{52}$ to bases 51-2B and 52-2B of PNP transistors 51-2 and 52-2. PNP transistors 51-2 and 52-2, in turn, amplify the modulation currents $I_{51}$ and $I_{52}$, and generate amplified modulation currents $I_{51-2}$ and $I_{52-2}$ between emitters 51-2E and 52-2E, and collectors 51-2C and 52-2C. As shown, emitters 51-2E and 52-2E, and collectors 51-2C and 52-2C are electrically connected across light emitters 401 and 402, respectively. Accordingly, the amplified modulation currents $I_{51-2}$ and $I_{52-2}$, which flow in circuit loops $L_1$ and $L_2$, are supplied respectively to light emitters 401 and 402. Light emitters 401 and 402 are thus driven respectively by driving currents $I_{401}$ and $I_{402}$ which are substantially equal to a constant bias current $I_b$ plus the respective amplified modulation current $I_{51-2}$ and $I_{52-2}$.

Figure 10A:
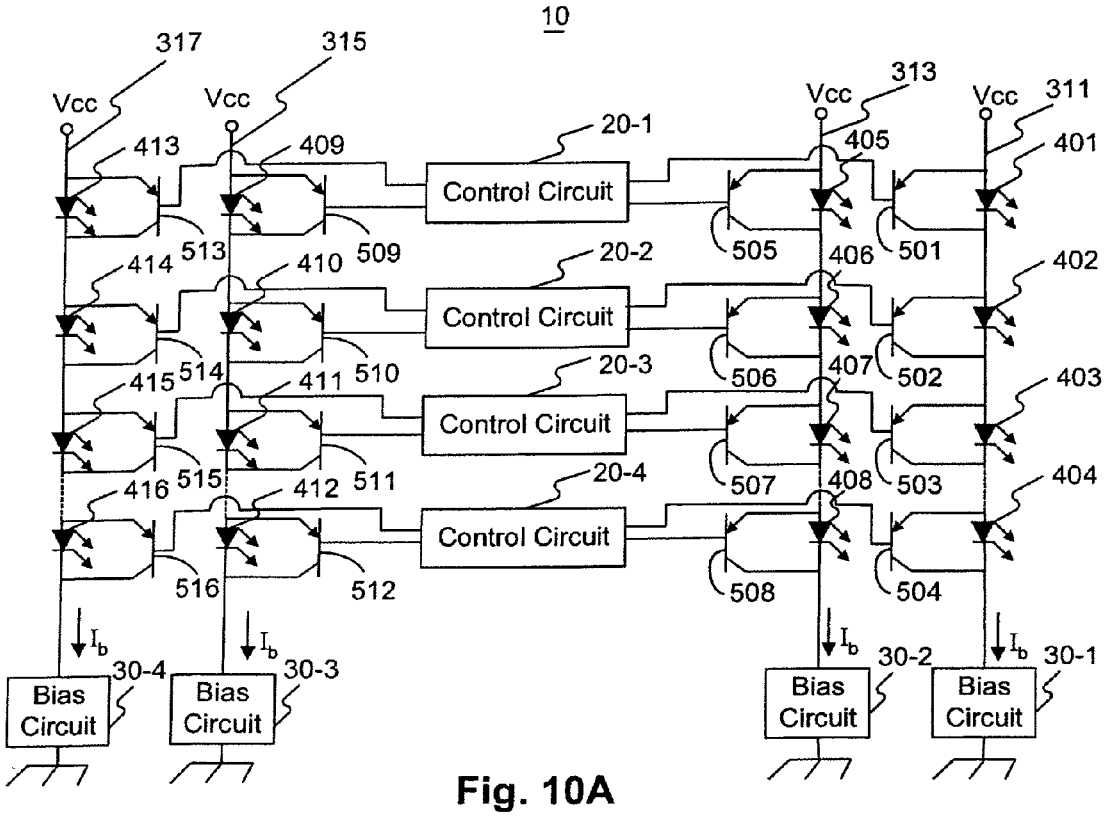
FIG. 10A illustrates a circuit array for individually driving an array of LEDs, in accordance with one embodiment consistent with the present invention.

Circuit 9 shown in FIG. 9A may be arranged in a circuit array 10 shown in FIG. 10A. As shown in FIG. 10A, circuit array 10 includes a plurality of bias circuits 30-1, 30-2, 30-3, and 30-4, a plurality of control circuits 20-1, 20-2, 20-3, and 20-4, and a plurality of amplifiers 501-516. In this example, circuit 10 includes four control circuits 20-1, 20-2, 20-3, and 20-4, four bias circuits 30-1, 30-2, 30-3, and 30-4 coupled to four current paths 311, 313, 315, and 317, and sixteen amplifiers 501-516. Control circuits 20-1, 20-2, 20-3, and 20-4, bias circuits 30-1, 30-2, 30-3, and 30-4, and amplifiers 501-516 drive light emitters 401-416 in a manner similar to that discussed above. In one embodiment, as shown in FIG. 10A, amplifiers 501-516 are PNP transistors.

Figure 10B:
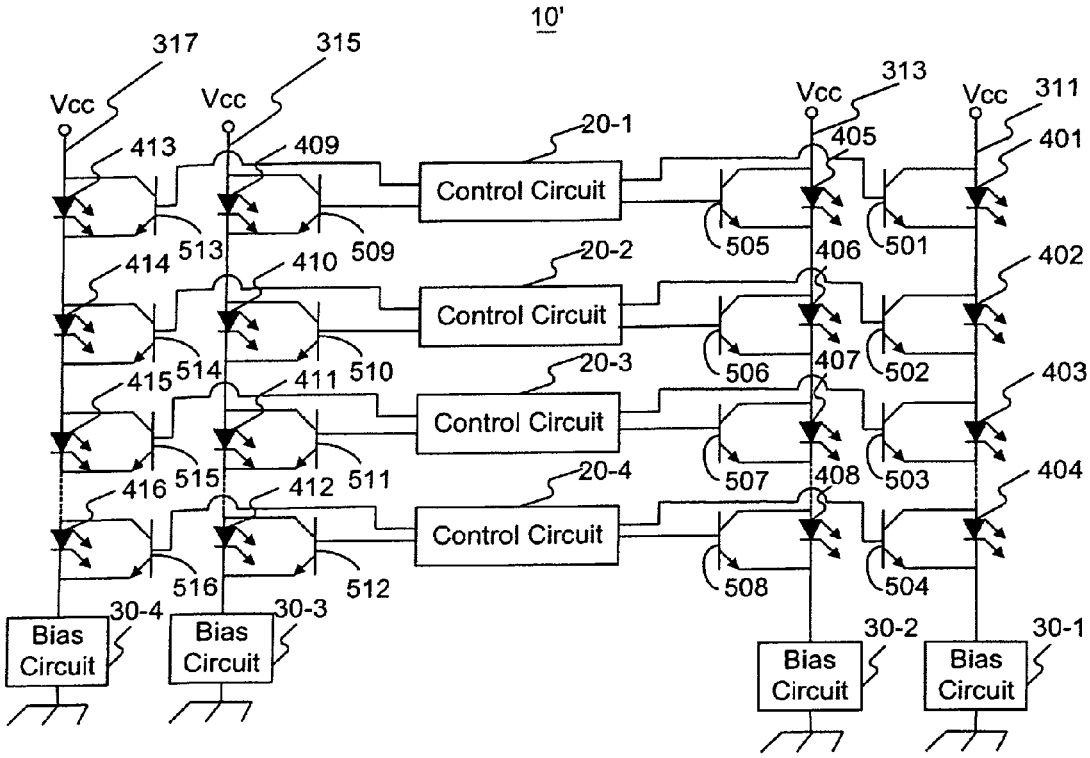
FIG. 10B illustrates a circuit array for individually driving an array of LEDs, in accordance with one embodiment consistent with the present invention.

Circuit 9 shown in FIG. 9B may also be arranged in a circuit array 10' shown in FIG. 10B. Circuit array 10' of FIG. 10B is similar to circuit array 10 of FIG. 10A. In this example, amplifiers 501-516 are NPN transistors.

Figure 11:
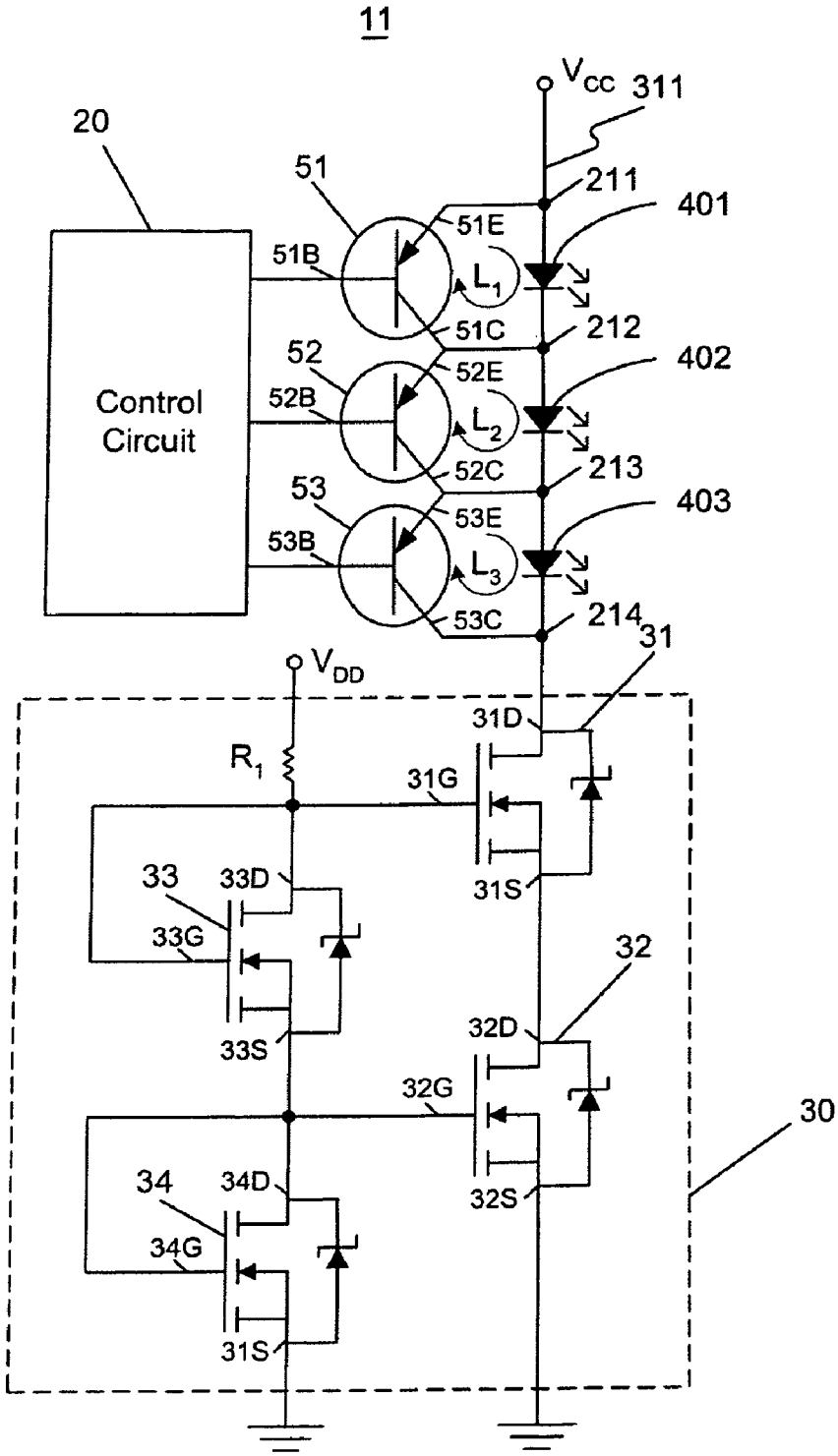
FIG. 11 illustrates, in more detail, a circuit for individually driving a series of LEDs, in accordance with one embodiment consistent with the present invention.

FIG. 11 illustrates a circuit 11 for individually driving a series of light emitters 401, 402, and 403, in accordance with one embodiment consistent with the present invention. In one embodiment, light emitters 401, 402, and 403 include LEDs. As shown in FIG. 11, light emitters 401, 402, and 403 are coupled in series along a current path 311. In this example, light emitter 401 emits red light, light emitter 402 emits green light, and light emitter 403 emits blue light. When light emitters 401, 402, and 403 are actuated simultaneously, the red, green, and blue light from each LED is combined to create white light. Thus, collectively, light emitters 401, 402, and 403 construct a white light source.

As shown in FIG. 11, circuit 11 includes a control circuit 20, a bias circuit 30, and a plurality of amplifiers 51, 52, and 53. In this example, amplifiers 51, 52, and 53 are PNP transistors 51, 52, and 53. Amplifiers 51, 52, and 53 include bases 51B, 52B, and 53B, emitters 51E, 52E, and 53E, and collectors 51C, 52C, and 53C. Emitter 51E is coupled to point 211 of current path 311. Collector 51C and emitter 52E are coupled to point 212 of current path 311. Collector 52C and emitter 53E are coupled to point 213 of current path 311. Collector 53C is coupled to point 214 of current path 311. Accordingly, emitters 51E, 52E, and 53E and collectors 51C, 52C, and 53C of amplifiers 51, 52, and 53 are electrically connected across a respective one of light emitters 401, 402, and 403, thereby forming circuit loops $L_1$, $L_2$, and $L_3$.

Control circuit 20 is coupled to the bases 51B, 52B, and 53B of amplifiers 51, 52, and 53. Control circuit 20 supplies a modulation current to the bases 51B, 52B, and 53B, in accordance with an optical output of the respective one of light emitters 401, 402, and 403, in a manner similar to that discussed above. In one embodiment, the modulation current is a PWM current. Amplifiers 51, 52, and 53 then amplify the modulation currents, and supply the amplified modulation currents to light emitters 401, 402, and 403. In this example, control circuit 20 may be an integrated circuit, e.g., type AS3691 commercially available from austriamicrosystems AG.

As shown in FIG. 11, bias circuit 30, in one embodiment, further includes a resistor $R_1$, and power MOSFETs 31, 32, 33, and 34. Bias circuit 30 supplies a constant current to current path 311. Each of light emitters 401, 402, and 403 is then driven by a driving current based on the constant current and the amplified modulation current. In one embodiment, the power MOSFETs 31, 32, 33, and 34 may be commercially available power MOSFETs, e.g., type RFP50N06 manufactured by Fairchild Semiconductor Co. Power MOSFETs 31, 32, 33, and 34 include gates 31G, 32G, 33G, and 34G, respectively, drains 31D, 32D, 33D, and 34D, respectively, and sources 31S, 32S, 33S, and 34S, respectively. Drain 31D is coupled to current path 311, and source 31S is coupled to drain 32D. Gates 31G and 33G, and drain 33D are coupled together to resister $R_1$, and gates 32G and 34G, and drain 34D are coupled together to source 33S. Sources 32S and 34S are grounded, and voltage source $V_{DD}$ is coupled to bias circuit 30 through resistor $R_1$. In this example, voltage source $V_{DD}$ supplies a voltage of five volts to bias circuit 30.

In order to verify that bias circuit 30 in this example can provide a substantially constant current while varying the modulation current, a few experimental measurements were performed. The measurement results are presented in Table 1.

TABLE 1

| $V_{CC}$ | | a) Not Connected | b) LED 401 off | c) LEDs 401, 402 off | d) All LEDs off |
|---|---|---|---|---|---|
| 10 V | $V_{DS}$(31) (V) | 0 | 1.12 | 1.18 | 2.25 |
| | $V_{GS}$ (31) (V) | 3.44 | 2.27 | 2.14 | 2.11 |
| | $V_{DS}$ (32) (V) | 0.82 | 2.00 | 2.11 | 2.13 |
| | $V_{GS}$ (32) (V) | 2.12 | 2.12 | 2.12 | 2.12 |
| | Bias Current (mA) | 300 | 398 | 408 | 410 |
| 11 V | $V_{DS}$(31) (V) | 0.01 | 1.62 | 3.10 | 4.87 |
| | $V_{GS}$ (31) (V) | 2.42 | 2.11 | 2.07 | 2.03 |
| | $V_{DS}$ (32) (V) | 1.81 | 2.11 | 2.14 | 2.19 |
| | $V_{GS}$ (32) (V) | 2.09 | 2.09 | 2.09 | 2.09 |
| | Bias Current (mA) | 300 | 325 | 332 | 337 |
| 12 V | $V_{DS}$(31) (V) | 0.75 | 2.58 | 4.30 | 5.76 |
| | $V_{GS}$ (31) (V) | 2.11 | 2.08 | 2.04 | 2.01 |
| | $V_{DS}$ (32) (V) | 2.10 | 2.13 | 2.16 | 2.19 |
| | $V_{GS}$ (32) (V) | 2.09 | 2.09 | 2.09 | 2.09 |
| | Bias Current (mA) | 300 | 303 | 307 | 312 |
| 13 V | $V_{DS}$(31) (V) | 1.72 | 2.09 | 4.68 | 5.85 |
| | $V_{GS}$ (31) (V) | 2.09 | 2.06 | 2.03 | 2.00 |
| | $V_{DS}$ (32) (V) | 2.13 | 2.14 | 2.17 | 2.20 |
| | $V_{GS}$ (32) (V) | 2.09 | 2.09 | 2.09 | 2.09 |
| | Bias Current (mA) | 300 | 302 | 307 | 312 |
| 14 V | $V_{DS}$(31) (V) | 2.65 | 4.20 | 5.89 | 7.08 |
| | $V_{GS}$ (31) (V) | 2.06 | 2.03 | 2.00 | 1.97 |
| | $V_{DS}$ (32) (V) | 2.14 | 2.17 | 2.20 | 2.23 |
| | $V_{GS}$ (32) (V) | 2.09 | 2.09 | 2.09 | 2.09 |
| | Bias Current (mA) | 300 | 303 | 308 | 310 |

In Table 1, different voltages $V_{CC}$ were applied to current path 311 and various drain-source, and gate-source voltages of transistors 31 and 32 were measured. In particular, these voltages were measured when: a) no LED was connected; b) LED 401 was off; c) LEDs 401 and 402 were off; and d) all LEDs 401, 402, and 403 were off. In Table 1, symbol $V_{DS}$(31) denotes the voltage across drain 31D and source 31S, while symbol $V_{GS}$(31) denotes the voltage across gate 31G and source 31S. Similarly, symbol $V_{DS}$(32) denotes the voltage across drain 32D and source 32S, while symbol $V_{GS}$(32) denotes the voltage across gate 32G and source 32S. Bias current flowing along current path 311 was also measured.

In Table 1, after power MOSFET 31 is saturated, namely $V_{GS}$(31) being substantially constant, voltage changes for turning on and off LEDs 401, 402, and 403 will not affect the bias current too abruptly. Therefore, bias circuit 30, in this example, may supply a constant bias current to current path 311, without being substantially affected by the modulation current supplied to individual LEDs 401, 402, and 403.

In addition, there is also provided a method for driving a light emitter. The method includes the steps of generating a first current, generating a second current based on an optical output of the light emitter, and supplying a third current to the light emitter, the third current being based on the first current and the second current. In this example, the first current is a constant current, and the second current is a pulse width modulated current. In one embodiment, the third current is substantially equal to a sum of the first current and the second current. In another embodiment, the third current is substantially equal to a difference of the first current and the second current.

As discussed above, the driving current for each color LED in a white light source can be controlled individually so that each LED continues to emit light at a desired intensity. As a result, variations in the optical output of such LEDs can be minimized so that the white light source can generate white light for extended periods of time. In addition, the combined current outputs of both the control and bias circuits can create a sufficiently high LED driving current. Thus, high LED driving currents can be generated without conventional high current integrated circuits, which can be relatively expensive. Further, the modulation currents discussed above can be generated with a single transistor and thus the LED drive circuitry consistent with the present invention can be realized with a relatively simple design.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A circuit for driving a light emitter, comprising:

a detector configured to detect an optical output of the light emitter;

a bias circuit configured to generate a bias current;

a control circuit configured to generate a control current, the control circuit including an amplifier having a transistor; and a current path having a first portion coupling the bias current to drive the light emitter and a second portion coupling the control current to drive the light emitter;

wherein the control circuit is further configured to regulate the control current driving the light emitter in response to the detected optical output of the light emitter, and a base of the transistor is coupled to the control circuit, a collector of the transistor is coupled to a first portion or a second portion of the current path, and an emitter of the transistor is coupled to an opposite one of the first and second portion coupled to the collector.

2. The circuit in accordance with claim 1, wherein the total current coupled to drive the light emitter is substantially equal to a sum of the bias current and the control current.

3. The circuit in accordance with claim 2, wherein the control current is pulse width modulated.

4. The circuit in accordance with claim 1, wherein the total current coupled to drive the light emitter is substantially equal to a difference of the bias current and the control current.

5. The circuit in accordance with claim 4, wherein the control current is pulse width modulated.

6. The circuit in accordance with claim 1, further comprising a driving circuit.

7. The circuit in accordance with claim 1, wherein the bias circuit includes a plurality of power MOSFETs.

8. The circuit in accordance with claim 1, wherein the light emitter includes a light emitting diode.

9. The circuit in accordance with claim 1, wherein the control circuit further includes a first control circuit coupled to the first portion of the current path, and a second control circuit coupled to the second portion of the current path.

10. The circuit as recited in claim 1, wherein the control circuit regulates the control current by varying a duty cycle of the control current in accordance with the detected optical output of the light emitter.

11. An illuminating system, comprising:

a plurality of light emitters, each of which being coupled to a corresponding one of a plurality of current paths;

a bias circuit coupled to the plurality of current paths and being configured to supply a bias current to each of the light emitters via the plurality of current paths;

a detector configured to detect optical outputs of the light emitters; and a control circuit coupled to the plurality of current paths and being configured to generate a plurality of modulation currents, and to regulate the plurality of modulation currents in response to the detected optical output of a respective one of the light emitters;

wherein the plurality of current paths couple to each of the plurality of light emitters a corresponding one of a plurality of driving currents, each of the plurality of driving currents comprising a corresponding one of the plurality of regulated modulation currents and the bias current, and the control circuit includes an amplifier having a transistor, a base of the transistor being coupled to the control circuit, a collector of the transistor being coupled to at least one of the plurality of current paths, and an emitter of the transistor being coupled to another of the plurality of current paths.

12. The illuminating system in accordance with claim 11, wherein said each of the plurality of driving currents is equal to a sum of said corresponding one of the plurality of modulation currents and the bias current.

13. The illuminating system in accordance with claim 11, wherein said each of the plurality of driving currents is equal to a difference between said corresponding one of the plurality of modulation currents and the bias current.

14. The illuminating system in accordance with claim 11, the control circuit further comprising a plurality of amplifiers, each of which corresponding to each of the plurality of light emitters, for amplifying each of the plurality of modulation currents.

15. The illuminating system in accordance with claim 14, wherein each of the plurality of amplifiers comprises a transistor.

16. The illuminating system in accordance with claim 11, wherein the plurality of light emitters comprises a plurality of light emitting diodes.

17. The illuminating system in accordance with claim 11, wherein the modulation current is pulse width modulated.

18. The illuminating system in accordance with claim 11, wherein the control circuit further includes a first control circuit portion and a second control circuit portion.

19. The illuminating system in accordance with claim 18, wherein the first control circuit portion includes a current source, and the second control circuit portion includes a current sink.

20. The illuminating system in accordance with claim 18, wherein the first control circuit portion includes a current sink, and the second control circuit portion includes a current source.

21. A method for driving a light emitter, comprising:

detecting an optical output of the light emitter;

generating a bias current;

generating a control current based on the detected optical output of the light emitter; and supplying a driving current to the light emitter, the driving current being based on the bias current and on the control current, the driving current being provided over a current path having a first portion and a second portion, the first portion being provided with the bias current and the second portion being provided with the control current, and wherein the generating of the control current includes using a control circuit having an amplifier including a transistor, a base of the transistor being coupled to the control circuit, a collector of the transistor being coupled to a first portion or a second portion, and an emitter of the transistor being coupled to an opposite one of the first and second portion coupled to the collector.

22. The method as recited in claim 21, wherein the bias current is a constant current.

23. The method as recited in claim 21, wherein the control current is pulse width modulated.

24. The method as recited in claim 21, wherein the driving current is substantially equal to a sum of the bias current and the control current.

25. The method as recited in claim 21, wherein the driving current is substantially equal to a difference of the bias current and the control current.

26. A circuit for driving a light emitter, the circuit comprising:

a detector configured to detect an optical output of the light emitter;

a bias circuit configured to supply a bias current to the light emitter;

a control circuit configured to supply a modulation current to the light emitter in accordance with the detected optical output of the light emitter; and an amplifier electrically connecting across the light emitter, the amplifier including a base, an emitter, and a collector, wherein the emitter, the collector, and the light emitter form a circuit loop;

wherein the control circuit supplies the modulation current to the base of the amplifier, the amplifier amplifies the modulation current and supplies the amplified modulation current to the light emitter via the emitter and the collector, thereby driving the light emitter by a driving current comprising the bias current and the amplified modulation current.

27. The circuit as recited in claim 26, wherein the bias circuit further comprises a plurality of power MOSFETs.

28. The circuit as recited in claim 26, wherein the driving current is substantially equal to a sum of the bias current and the amplified modulation current.

29. The circuit as recited in claim 26, wherein the driving current is substantially equal to a difference of the constant current and the amplified modulation current.

* * * * *